US009409307B2

(12) United States Patent
Lee

(10) Patent No.: US 9,409,307 B2
(45) Date of Patent: Aug. 9, 2016

(54) PUNCHING DEVICE

(71) Applicant: Chung-Yi Lee, New Taipei (TW)

(72) Inventor: Chung-Yi Lee, New Taipei (TW)

( * ) Notice: Subject to any disclaimer, the term of this patent is extended or adjusted under 35 U.S.C. 154(b) by 204 days.

(21) Appl. No.: 14/148,112

(22) Filed: Jan. 6, 2014

(65) Prior Publication Data

US 2014/0165811 A1 Jun. 19, 2014

Related U.S. Application Data

(63) Continuation-in-part of application No. 13/024,852, filed on Feb. 10, 2011, now abandoned.

(30) Foreign Application Priority Data

Mar. 8, 2010 (TW) ..... 99204033 U
Mar. 25, 2010 (CN) ..... 2010 2 0151904 U

(51) Int. Cl.

| | |
|---|---|
| ***B26D 5/08*** | (2006.01) |
| ***B26F 1/02*** | (2006.01) |
| ***B26F 1/38*** | (2006.01) |
| ***B26D 5/16*** | (2006.01) |
| ***B26D 5/10*** | (2006.01) |
| ***B26F 1/36*** | (2006.01) |

(52) U.S. Cl.

CPC ... *B26F 1/38* (2013.01); *B26D 5/08* (2013.01); *B26D 5/10* (2013.01); *B26D 5/16* (2013.01); *B26F 1/02* (2013.01); *B26F 1/36* (2013.01); *Y10T 83/8785* (2015.04); *Y10T 83/885* (2015.04); *Y10T 83/8838* (2015.04); *Y10T 83/9425* (2015.04)

(58) Field of Classification Search

CPC ..... B26F 1/36; B26F 1/38; B26F 1/02; B26F 1/04; B26F 1/14; B26D 3/10; B26D 5/08; B26D 5/10; B26D 5/16; Y10T 83/8837; Y10T 83/8838; Y10T 83/884; Y10T 83/8841; Y10T 83/8843; Y10T 83/8845; Y10T 83/8848; Y10T 83/885; Y10T 83/8851; Y10T 83/8853; Y10T 83/8785; Y10T 83/9423; Y10T 83/9425; Y10T 83/9428

USPC ..... 83/624–628, 630, 632–635, 588, 83/684–686

See application file for complete search history.

(56) References Cited

U.S. PATENT DOCUMENTS 1,146,089 A 7/1915 Neely
1,987,455 A 1/1935 Washburn (Continued)

FOREIGN PATENT DOCUMENTS

TW 195243 3/1981
WO 2011/156718 A1 * 12/2011 ..... B26F 1/04

*Primary Examiner* — Clark F Dexter
(74) *Attorney, Agent, or Firm* — The Webb Law Firm

(57) ABSTRACT

A punching device includes: a housing with a flange part and an upper part; a die part; a punch supported movably on the flange part; and two driving levers abutting against the upper part and the punch and rotatable between initial and cutting positions. Each of the driving levers has a protrusion, first and second end segments and a middle segment between the first and second segments. When the driving levers are disposed at the initial position, the middle segments overlap each other in a second direction. When the driving levers are disposed at the cutting position, the second end segment of one of the driving levers overlaps the first end segment of the other one of the driving levers in the second direction.

3 Claims, 11 Drawing Sheets

(56) References Cited

U.S. PATENT DOCUMENTS

| | | | | |
|---|---|---|---|---|
| 3,733,466 | A | 5/1973 | Krumrey | |
| 6,428,248 | B1 | 8/2002 | Lee | |
| RE38,219 | E | 8/2003 | Lee et al. | |
| 7,201,101 | B2 | 4/2007 | Oh | |
| 2008/0314219 | A1* | 12/2008 | Liu | B26F 1/36 83/618 |
| 2009/0049967 | A1 | 2/2009 | Chang | |
| 2011/0303068 | A1* | 12/2011 | Exley et al. | B26F 1/04 83/698.21 |

* cited by examiner

PUNCHING DEVICE

CROSS REFERENCE TO RELATED APPLICATIONS

This application is a Continuation-in-Part (CIP) of U.S. patent application Ser. No. 13/024,852 filed on Feb. 10, 2011, which claims priority to Taiwanese Patent Application No. 099204033, filed on Mar. 8, 2010, and Chinese Patent Application No. 201020151904.1, filed on Mar. 25, 2010, which are incorporated herein by reference in their entirety.

BACKGROUND OF THE INVENTION

1. Field of the Invention

This invention relates to a punching device, more particular to a punching device including a pair of driving levers for driving a punch to slide against a die for cutting a sheet.

2. Description of the Related Art

Referring to FIG. 1, Taiwanese Patent Application No. 81203592 discloses a conventional punching device 100 that is used in the craft industry for cutting a sheet (not shown), such as a paper sheet and a plastic sheet, in a predetermined pattern to form a craft article. The punching device 100 includes a base 11, a punch 12, a compression spring 13, a pressing button 14, and a cap 15. The base 11 includes a bottom plate 111 and a supporting plate 112 parallel to and connected to the bottom plate 111 and cooperating with the bottom plate 111 to define a gap 10 for extension of the sheet therein. The bottom plate 111 is formed with a die hole 113 for passage of the punch 12 therethrough. The pressing button 14 is seated on the punch 12 for pressing the punch 12 against the compression spring 13 so as to move the punch 12 along a vertical axis (X) into and through the die hole 113 in the bottom plate 111, thereby cutting the sheet. The compression spring 13 restores the punch 12 to its original position after punching. The cap 15 covers the punch 12 and the supporting plate 112 and is formed with a top opening for extension of the pressing button 14 therethrough. Since the force acted on the pressing button 14 is directly transmitted to the punch 12 in the vertical axis (X), it is laborious when using the aforesaid punching device to cut a thick sheet.

Referring to FIG. 2, U.S. Pat. No. RE38219 discloses a punching device 200 including a base 21, a punch 22, a compression spring unit 23, a cap 24 and a pressing lever 25. The base 21 has a bottom plate 211 and a supporting plate 212 disposed above and connected to the bottom plate 211 through a connecting wall 217 and cooperating with the bottom plate 211 to define a gap 213 therebetween for receiving a sheet (not shown) therein. The bottom plate 211 is formed with a die hole 214. The supporting plate 212 has one end provided with a pivot seat 216, and is formed with a through-hole 215 aligned with the die hole 214 for extension of the punch 22 therethrough and into the die hole 214. The punch 22 has a bottom blade edge 221 for cutting the sheet. The compression spring unit 23 abuts against the supporting plate 212 and the punch 22 for restoring the punch 22 to its original position. The pressing lever 25 has a pivot end 251 pivoted to the pivot seat 216, a pressing end 253 opposite to the pivot end 251, and a driving protrusion 252 that is disposed between the pivot end 251 and the pressing end 253 and that is aligned with the punch 22 along a vertical axis (Y) perpendicular to the sheet. When the pressing end 253 of the pressing lever 25 is pressed, the driving protrusion 252 presses the punch 22 to move along the vertical axis (Y) into and through the die hole 214, thereby cutting the sheet.

Although the pressing lever 25 of the punching device 200 permits a less force required to punch the sheet as compared to the previous conventional punching device 100, it undesirably and considerably increases the length of the punching device 200 attributed to the length of the pressing lever 25. Moreover, according to the lever principle, the shorter the distance between the pivot end 251 (fulcrum) and the driving protrusion 252 (load) and the longer the distance between the pivot end 251 and the pressing end 253 (effort), the more will be the mechanical advantage, i.e., the less effort is required. Since the contact between the driving protrusion 252 and the punch 22 is required to be located on the vertical axis (Y) in order to prevent imbalance problem for the punch 22 (inclination of the punch 22 or uneven movement of the punch 22) from occurring, the distance between the pivot end 251 and the driving protrusion 252 is fixed and cannot be reduced. As a consequence, the longer the distance between the pivot end 251 and the driving protrusion 252, the longer the distance between the pivot end 251 and the pressing end 253 is required to maintain the same effort. In addition, since the pressing end 253 of the pressing lever 25 is located at one side of the punch device 200 and is relatively far from the vertical axis (Y), the dimensions of the base 21 are required to be enlarged in order to increase the stability of the punch device 200 and to prevent the punch device 200 from raising up or flipping over upon pressing of the pressing end 253, thereby further increasing the overall size of the punch device 200.

SUMMARY OF THE INVENTION

Therefore, an object of the present invention is to provide a punching device that can easily punch a sheet without increasing the size of the punching device as encountered in the prior art.

According to the present invention, there is provided a punching device for cutting a sheet. The punching device comprises: a housing defining an inner housing space and having a surrounding frame part, an upper part and a flange part, the surrounding frame part having upper and lower end portions, the upper part being movably supported on the upper end portion of the surrounding frame part and having an abutting protrusion, the flange part extending transversely from the lower end portion of the surrounding frame part, being formed with a lower spring-holding member, and defining a flange hole; two opposite pivot seats protruding upwardly from the flange part into the inner housing space and opposite to each other in a first direction; a die part disposed below and operatively connected to the flange part; a punch unit including a punch head, an upper spring-holding member, and a punch, the upper spring-holding member protruding upwardly from the punch head, the punch being disposed between the pivot seats and extending downwardly from the punch head toward the die part; a spring extending between and abutting against the upper and lower spring-holding members, so that the punch unit can be supported movably on the flange part and that the punch is slidable through the flange hole and against the die part along a vertical axis substantially perpendicular to the first direction; and a pressing unit including two driving levers, each of which has a pivot end that is pivoted to a respective one of the pivot seats, a pressing end that is opposite to the pivot end, a first end segment that extends along a first line of its length direction from the pivot end, a second end segment that extends along a second line of its length direction from the pressing end, a middle segment that interconnects and that deflects from the first and second end segments, and a driving protrusion disposed between the pivot end and the pressing end and protruding therefrom toward the punch unit. The middle segment has curved first and second end portions that turn curvedly and respectively from the first and second end segments. The first lines, along which the first end segments extend, intersect each other at the vertical axis. The second lines, along which the second end segments extend, are substantially parallel to each other and are spaced apart from the vertical axis. The vertical axis is disposed between the driving protrusions of the driving levers. The driving protrusions of the driving levers are disposed in a symmetrical manner with respect to the vertical axis, and press against the punch unit to drive movement of the punch unit along the vertical axis toward the die part for cutting the sheet. The upper part is disposed on and abuts against the pressing ends of the driving levers, and is movable relative to the surrounding frame part along the vertical axis for pressing the driving levers to rotate relative to the surrounding frame part. The driving levers are rotatable relative to the surrounding frame part about first and second rotational axes, respectively, between an initial position and a cutting position. The first and second rotational axes are transverse to the first direction and the vertical axis. When the driving levers are disposed at the initial position, the abutting protrusion of the upper part is pushed by the pressing ends of the driving levers to abut against the upper end portion of the surrounding frame part by the urging action of the spring and in the meantime the driving levers extend upwardly and respectively from the pivot ends to the pressing ends and cross each other. When the driving levers are disposed at the cutting position, the abutting protrusion of the upper part is spaced apart from the upper end portion of the surrounding frame part.

BRIEF DESCRIPTION OF THE DRAWINGS

In drawings which illustrate embodiments of the invention.

DETAILED DESCRIPTION OF THE PREFERRED. EMBODIMENTS

Figure 1:
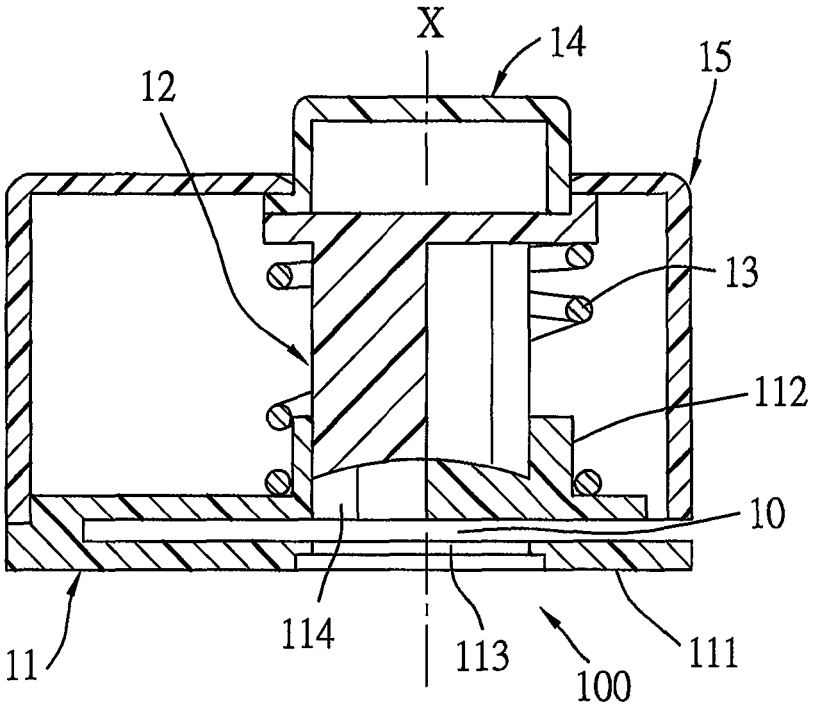
FIG.1 PRIOR ART
FIG. 1 is a sectional view of a conventional punching device.
Figure 2:
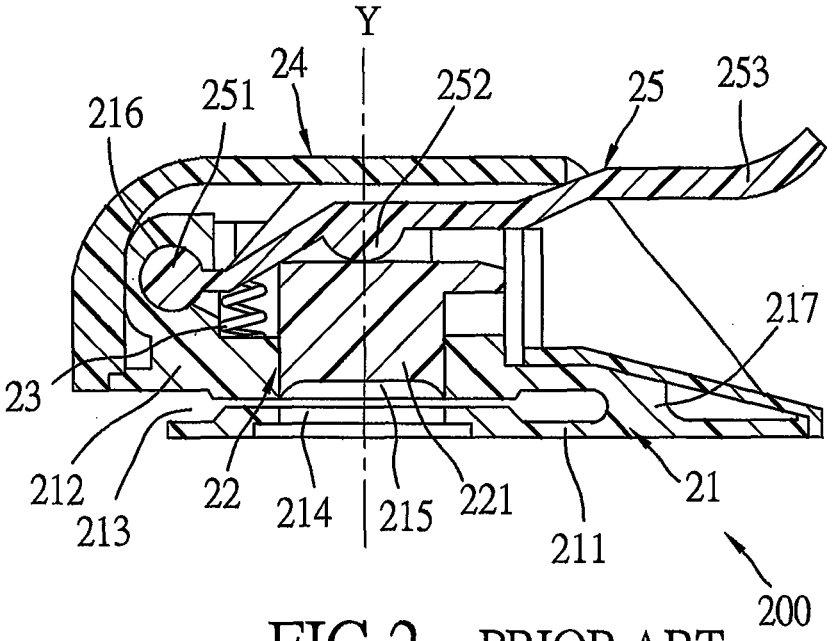
FIG.2 PRIOR ART
FIG. 2 is a sectional view of another conventional punching device.
Figure 3:
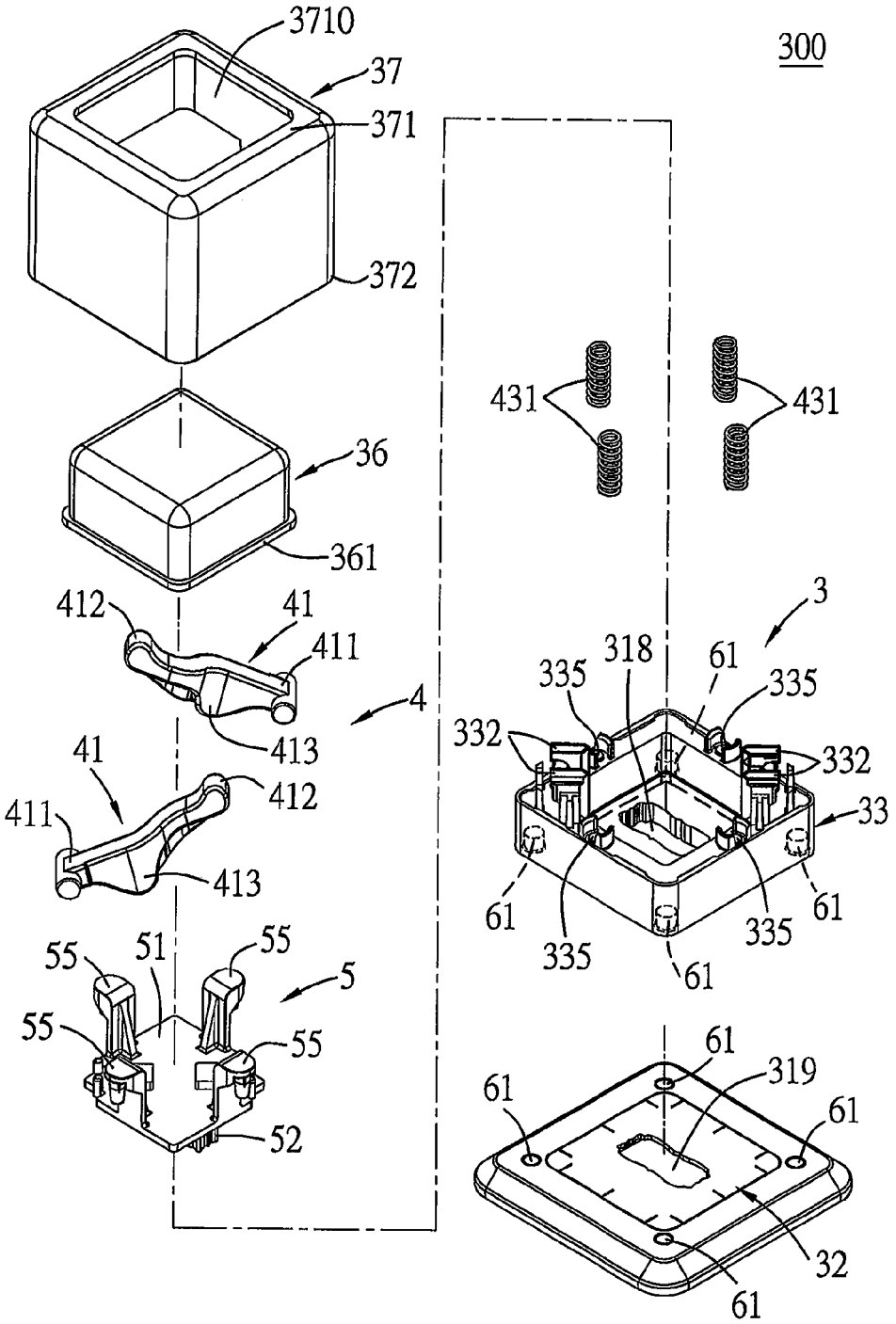
FIG. 3 is an exploded perspective view of the first preferred embodiment of a punching device according to this invention.
Figure 4:
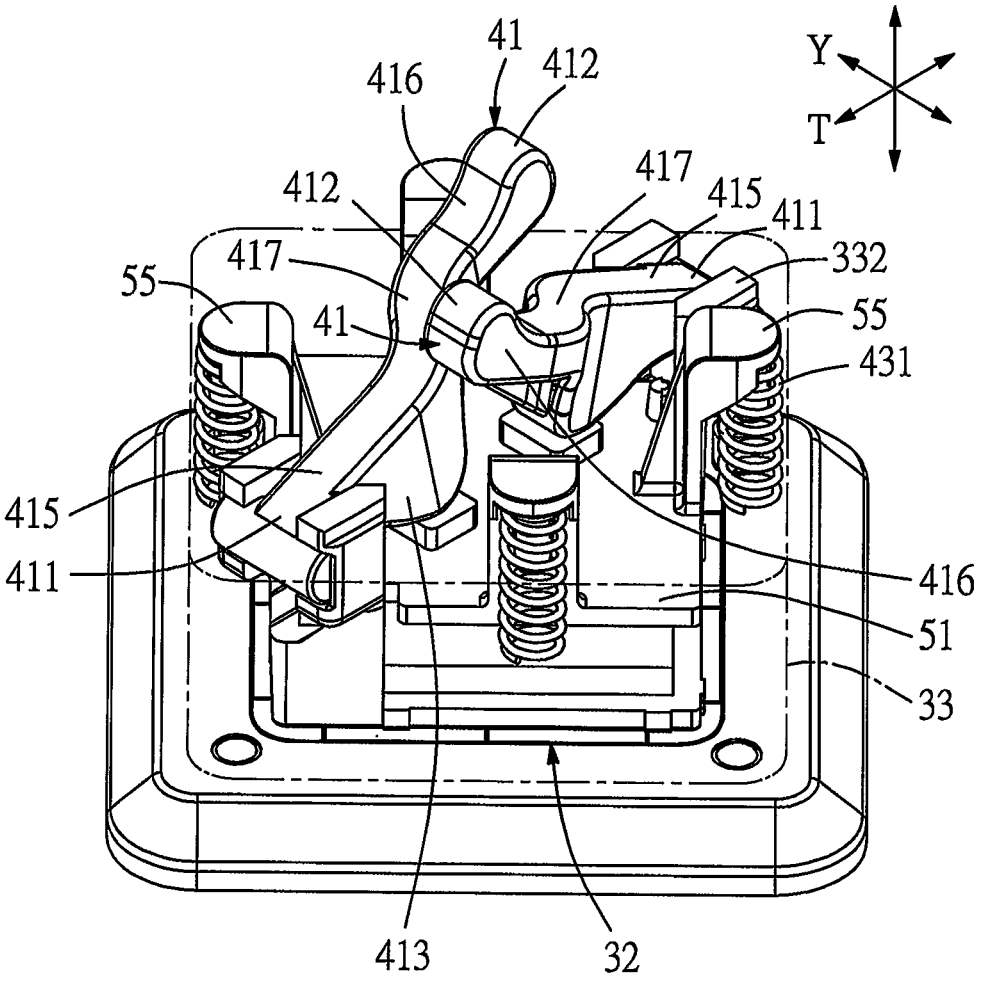
FIG. 4 is an assembled perspective view illustrating a configuration of a portion of the first preferred embodiment.
Figure 5:
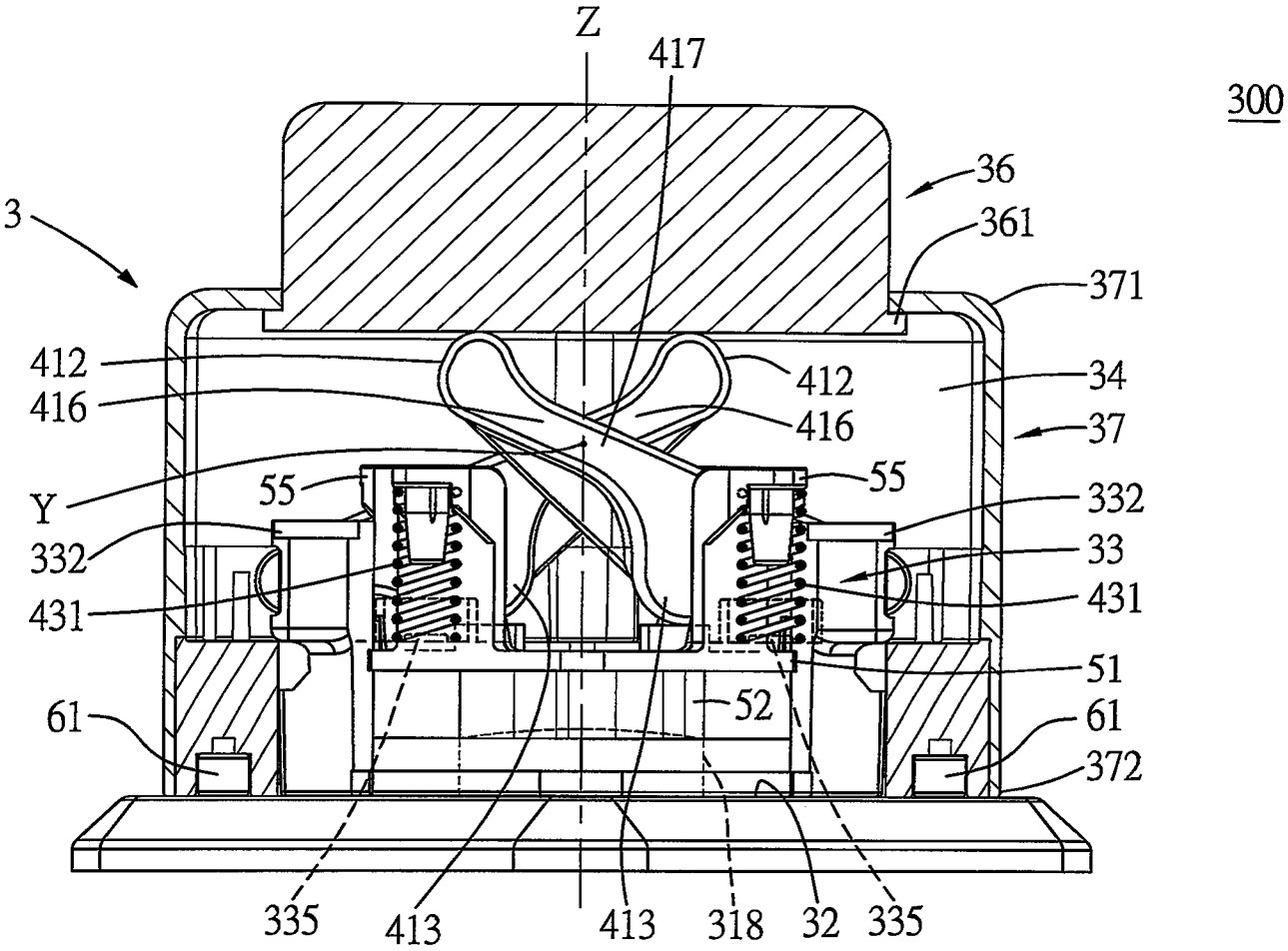
FIG. 5 is a sectional view of the first preferred embodiment, illustrating an initial state where a pressing unit is disposed at an initial position.
Figure 6:
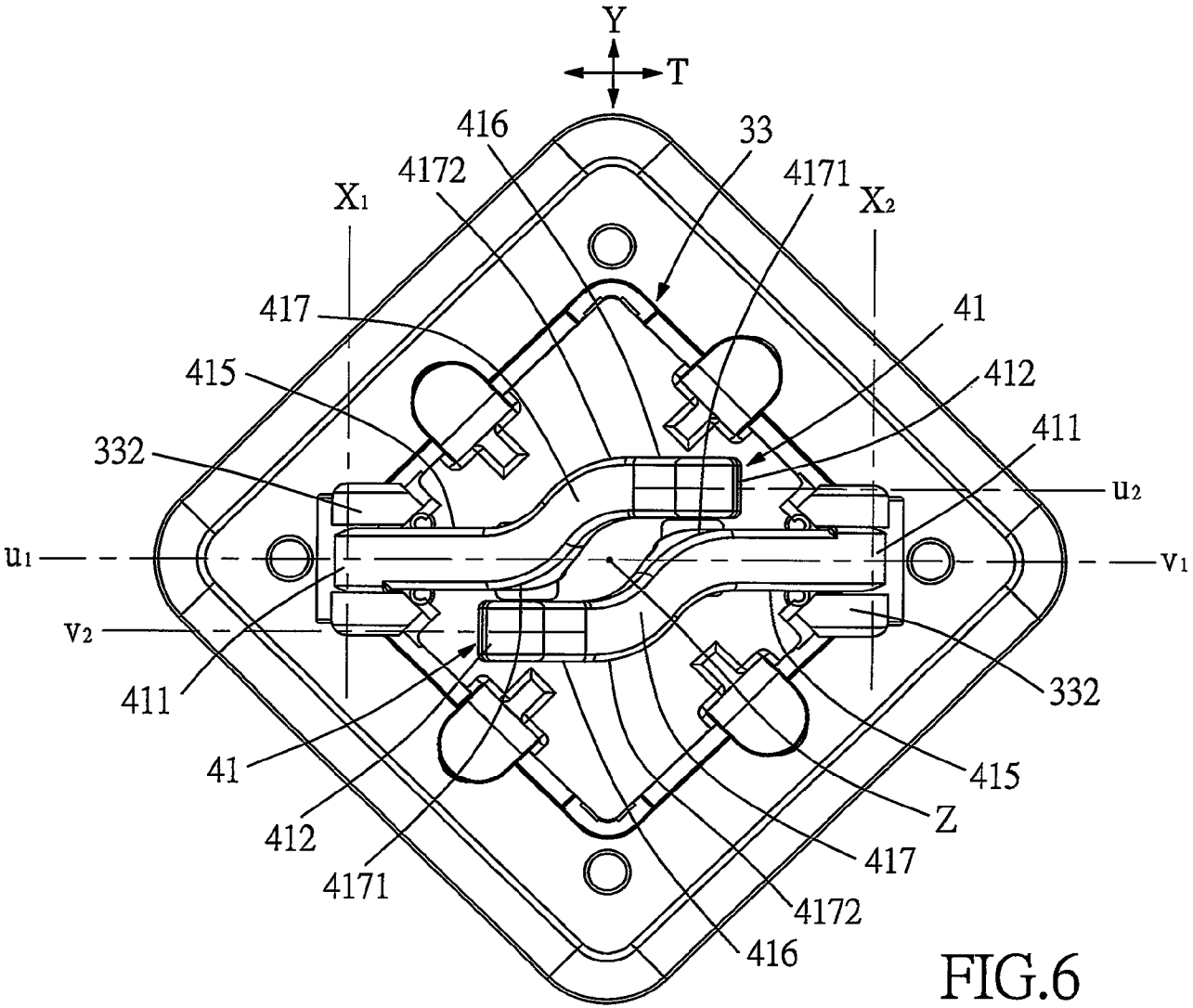
FIG. 6 is a top view of the first preferred embodiment, illustrating the initial state of the pressing unit.

Before the present invention is described in greater detail with reference to the accompanying preferred embodiments, it should be noted herein that like elements are denoted by the same reference numerals throughout the disclosure.

Referring to FIGS. 3 to 8, the first preferred embodiment of a punching device 300 for cutting a sheet of paper (not shown) according to the present invention is shown to include: a housing 3 defining an inner housing space 34 and having a surrounding frame part 37, an upper part 36 and a flange part 33, the surrounding frame part 37 having upper and lower end portions 371, 372, the upper part 36 being movably supported on the upper end portion 371 of the surrounding frame part 37 and having a bottom peripheral end and an abutting protrusion 361 that protrudes outwardly from the bottom peripheral end, the flange part 33 being detachably and securely connected to and extending transversely from the lower end portion 372 of the surrounding frame part 37, being formed with a plurality of lower spring-holding members 335, and defining a flange hole 318; two pivot seats 332 that are opposite to each other in a first direction (T) and that protrude upwardly from the flange part 33 into the inner housing space 34, each of the pivot seats 332 having a pair of C-shaped hooks; a die part 32 disposed below and operatively connected to the surrounding frame part 37; a punch unit 5 including a punch head 51, a plurality of upper spring-holding members 55, and a punch 52 extending downwardly from the punch head 51 toward the die part 32 and disposed directly above the die part 32 and between the pivot seats 332, the upper spring-holding members 55 protruding upwardly from the punch head 51; a plurality of springs 431 extending between and abutting against the upper and lower spring-holding members 55, 335, so that the punch unit 5 can be supported movably on the flange part 33 and that the punch 52 is slidable through the flange hole 318 and against the die part 32 along a vertical axis (Z) substantially perpendicular to the first direction (T); and a pressing unit 4 including two driving levers 41, each of which has a pivot end 411 and a pressing end 412.

Figure 7:
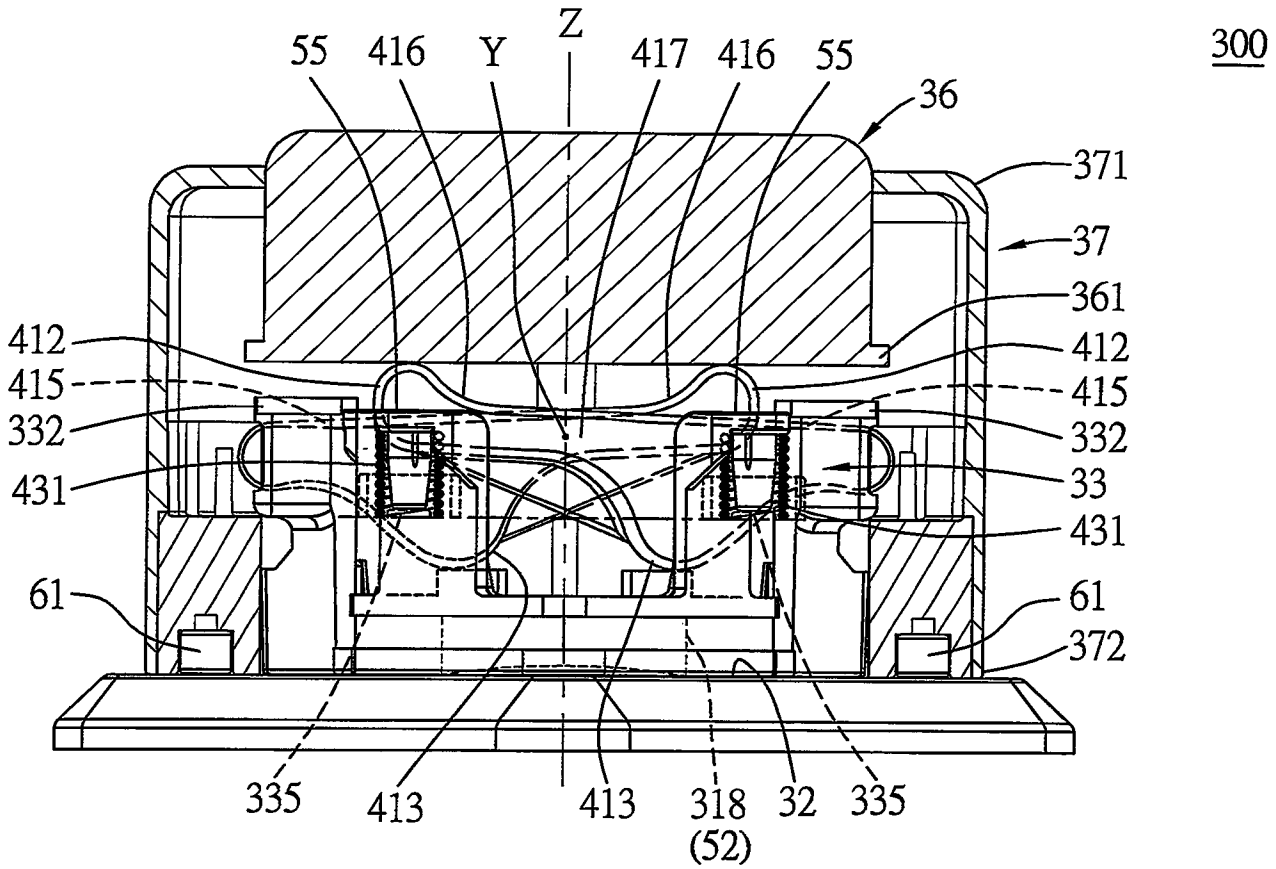
FIG. 7 is a sectional view of the first preferred embodiment, illustrating a cutting state where the pressing unit is disposed at a cutting position.
Figure 8:
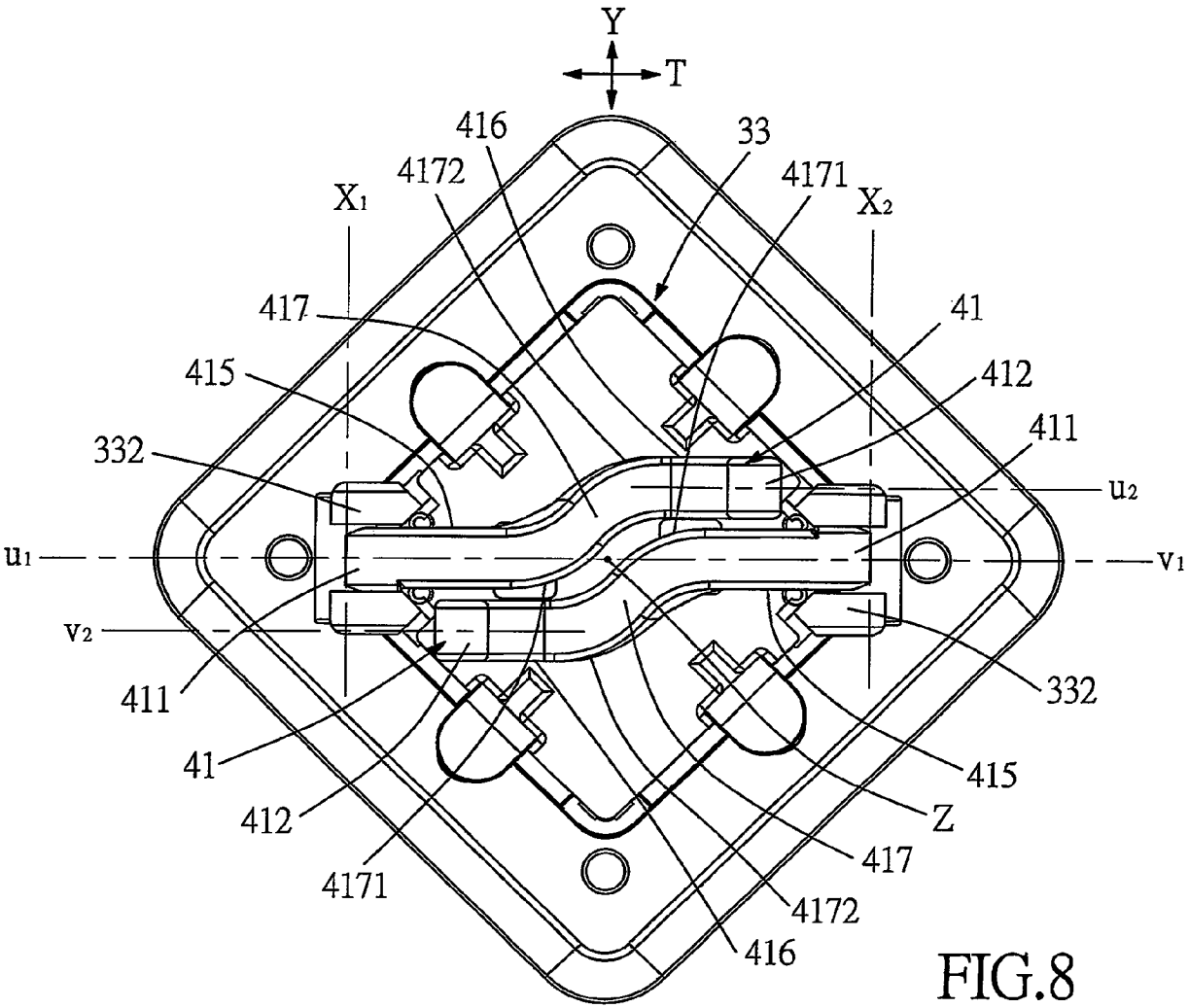
FIG. 8 is a top view of the first preferred embodiment, illustrating the cutting state of the pressing unit.
Figure 9:
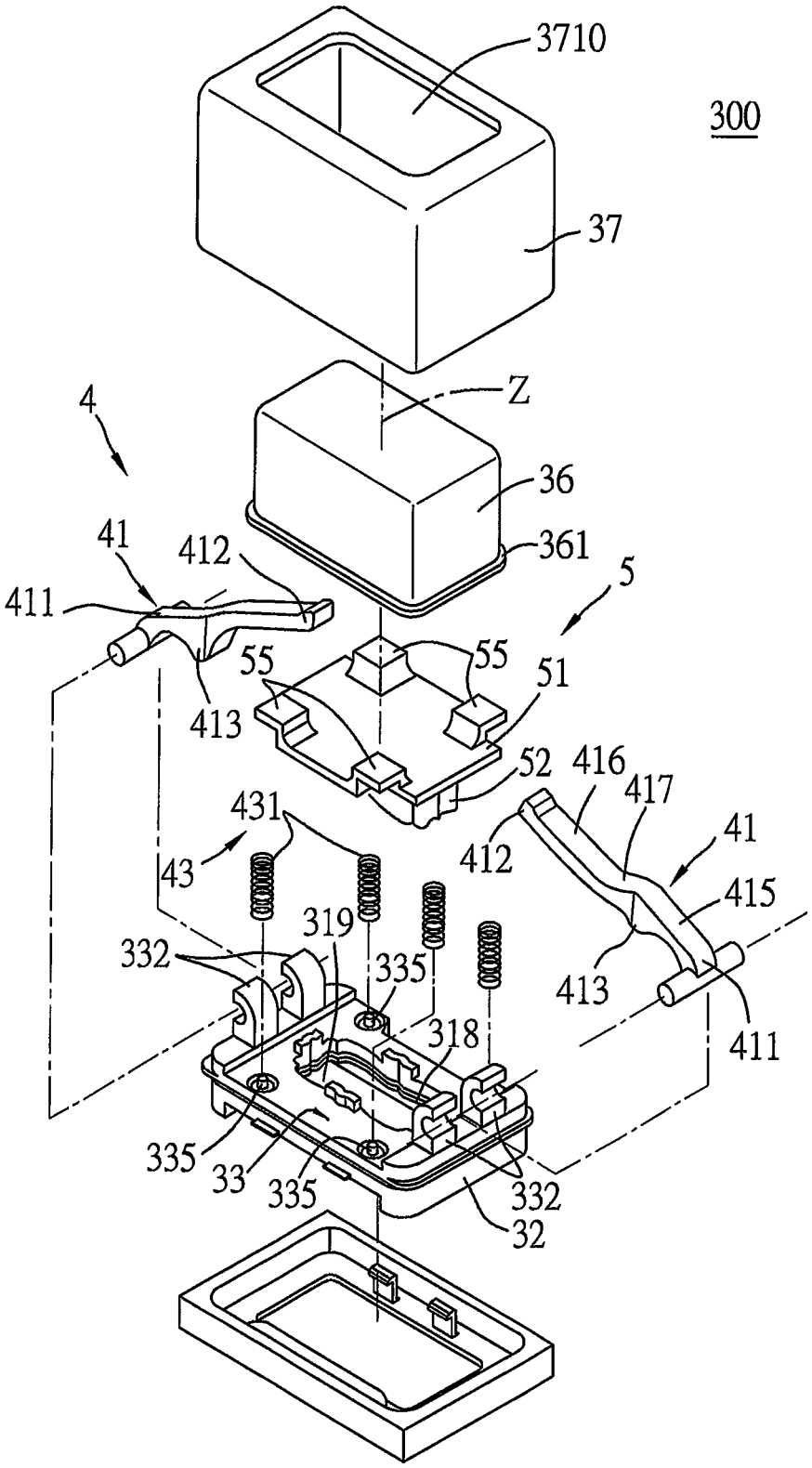
FIG. 9 is an exploded perspective view of the second preferred embodiment of the punching device according to this invention.
Figure 10:
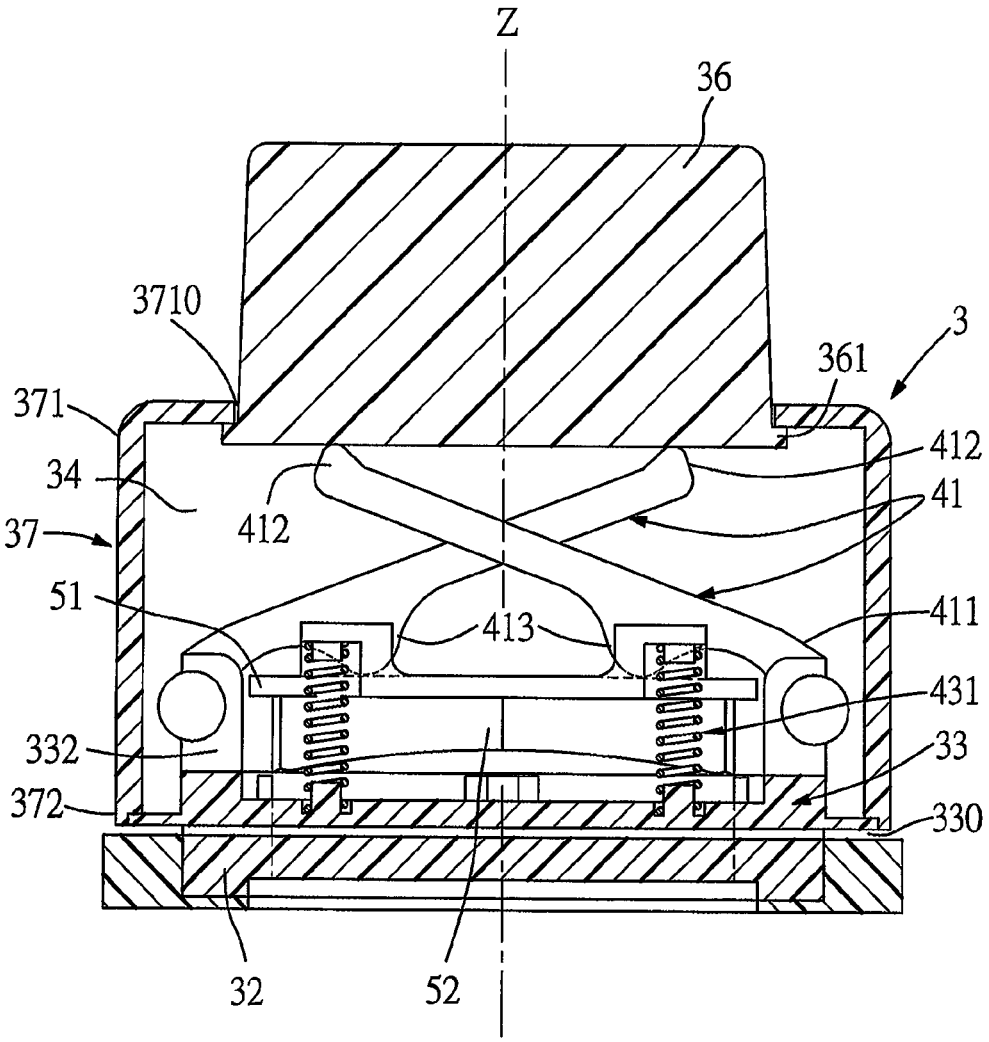
FIG. 10 is a sectional view of the second preferred embodiment, illustrating the initial state of the pressing unit.
Figure 11:
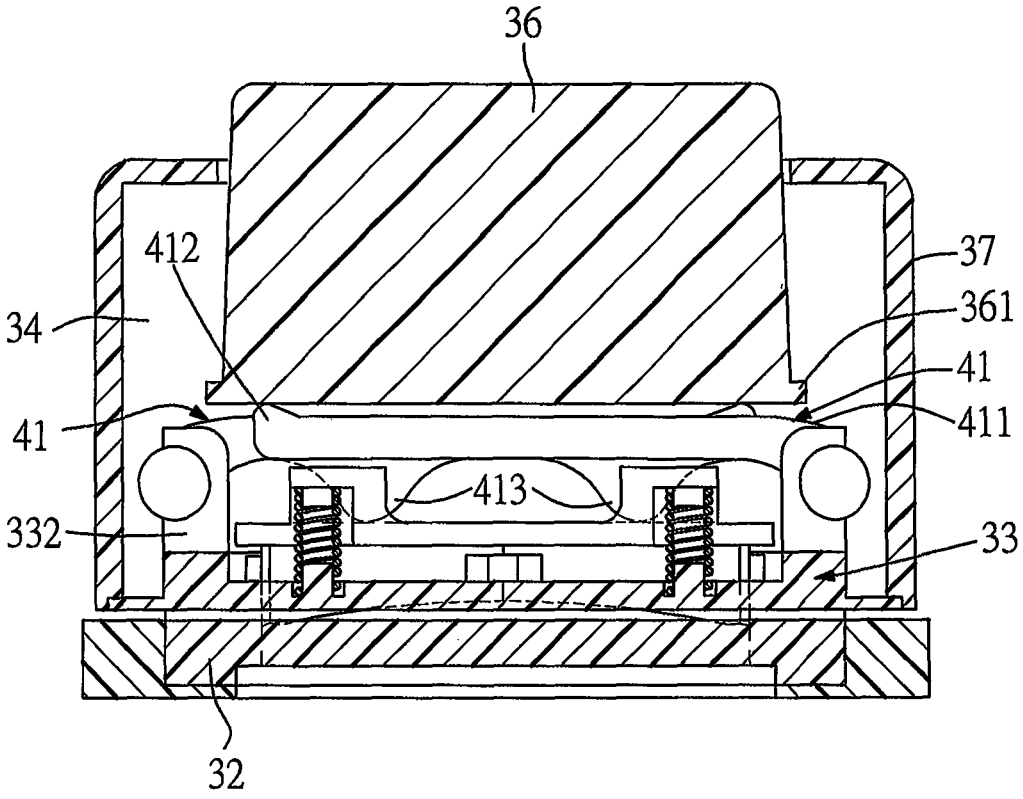
FIG. 11 is a sectional view of the second preferred embodiment, illustrating the cutting state of the pressing unit.
Figure 12:
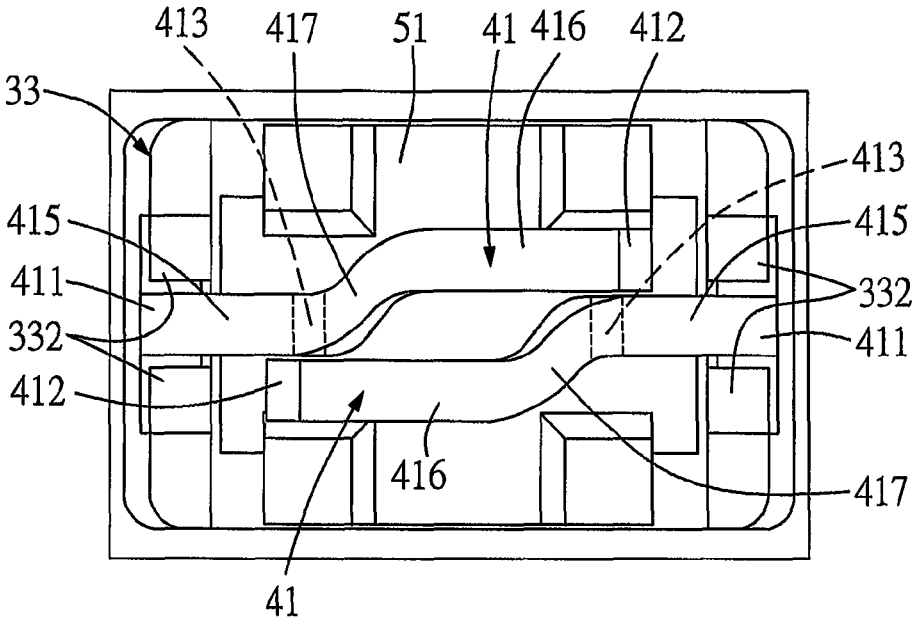
FIG. 12 is a top view of the second preferred embodiment, illustrating the cutting state of the pressing unit.

The pivot ends 411 of the driving levers 41 are respectively pivoted to the C-shaped hooks of the pivot seats 332 so that the driving levers 41 are rotatable relative to the flange part 33 about first and second rotational axes (X1, X2), respectively, between an initial position (FIGS. 5 and 6) and a cutting position (see FIGS. 7 and 8). The first and second rotational axes (X1, X2) are transverse to the first direction (T) and the vertical axis (Z). The driving protrusion 413 of each of the driving levers 41 is disposed between the pivot end 411 and the pressing end 412, and protrudes therefrom toward the punch unit 5. The vertical axis (Z) is disposed between the driving protrusions 413 of the driving levers 41.

The driving protrusions 413 of the driving levers 41 are disposed respectively at two sides of the vertical axis (Z) in a symmetrical manner with respect to the vertical axis (Z), and press against the punch unit 5 for driving movement of the punch unit 5 along the vertical axis (Z) toward the die part 2 for cutting the sheet.

The upper end portion 371 of the surrounding frame part 37 has a generally U-shaped cross-section, and defines an opening 3710 for extension of the upper part 36 therethrough.

The upper part 36 is disposed on and has a bottom end face that abuts constantly against the pressing ends 412 of the driving levers 41. The upper part 36 is movable relative to the surrounding frame part 37 along the vertical axis (Z) for pressing the driving levers 41 to rotate relative to the flange part 33 and the surrounding frame part 37.

The flange part 33 is generally rectangular in shape, has four corners, and is disposed directly above the die part 32. The pivot seats 332 are disposed at two diagonally aligned ones of the corners, respectively. The die part 32 has a die hole 319 for extension of the punch 52 therethrough. In this embodiment, the die part 32 is magnetically attached to the flange part 33 through a magnetic unit so as to be operatively connected to the surrounding frame part 37 through the flange part 33. The magnetic unit includes a plurality of magnets 61 which are secured to the die part 32 and the flange part 33, so that the sheet of paper can be placed on the die part 32 for punching before the die part 32 is magnetically attached to the flange part 33 to sandwich the sheet of paper therebetween.

Referring to FIGS. 5 to 8, the driving levers 41 cross each other and the vertical axis (Z) and are disposed in a symmetrical manner. Each of the driving levers 41 includes first and second end segments 415, 416 and a middle segment 417 that interconnects and that deflects obliquely from the first and second end segments 415, 416 so that the first and second end segments 415, 416 are offset from each other. The middle segment 417 has curved first and second end portions 4171 that turn curvedly and respectively from the first and second end segments 415, 416. The first end segments 415 of the driving levers 41 extend respectively along first lines (u1, v1) of their length direction from the pivot ends 411 of the driving levers 41. The second end segments 416 of the driving levers 41 extend respectively along second lines (u2, v2) of their length direction from the pressing ends 412 of the driving levers 41. The first lines (u1, v1) intersect each other at the vertical axis (Z). The second lines (u2, v2) are substantially parallel to each other, and are spaced apart from the vertical axis (Z).

When the driving levers 41 are disposed at the initial position, the abutting protrusion 361 of the upper part 36 is pushed by the pressing ends 412 of the driving levers 41 to abut against the upper end portion 371 of the surrounding frame part 37 by the urging action of the springs 431 and in the meantime the driving levers 41 extend upwardly and respectively from the pivot ends 411 to the pressing ends 412 and cross each other in such a manner that the second end segments 416 extend upwardly and respectively from the middle segments 417 in a direction inclined to the first direction (T) and that the second end portions 4172 of the middle segments 417 overlap each other in a second direction (Y), which is perpendicular to the vertical axis (Z) and the first direction (T). When the driving levers 41 are disposed at the cutting position, the abutting protrusion 361 of the upper part 36 is spaced apart from the upper end portion 271 of the surrounding frame part 37 and in the meantime the second end segment 416 of one of the driving levers 41 overlaps the first end segment 415 of the other one of the driving levers 51 in the second direction (Y) and the second end segment 416 of said the other one of the driving levers 41 overlaps the first end segment 415 of said one of the driving levers 51 in the second direction (Y). In addition, the second end portions 4172 of the middle segments 417 are misaligned with each other in the second direction (Y) when the driving levers 41 are disposed at the cutting position.

The diagonal relation of the relative position between the driving levers 41 and the configuration of the first and second end segments 415, 416 and the middle segment 417 permits achievement of a compact design of the punching device.

The extension of the driving levers 41 to cross each other results in an increase in the lever arm of force and permits the driving protrusions 413 to be positioned at positions closer to the vertical axis (Z), which has the advantage of preventing the punch 22 from becoming obliquely relative to the vertical axis (Z) due to unbalanced forces acting on the pressing ends 412 of the driving levers 41 during punching. In addition, the extension of the driving levers 41 to cross each other further permits the pressing ends 412 of the driving levers 41 to have sufficient heights relative to the flange part 33, which is advantageous in providing a sufficient traveling distance for the pressing ends 412 of the driving levers 41 during a punching operation.

FIGS. 9 to 12 illustrate the second preferred embodiment of the punching device 300 according to this invention. The second preferred embodiment differs from the previous embodiment in that each of the pivot seats 332 is disposed at a middle position between two adjacent ones of the corners.

Figure 13:
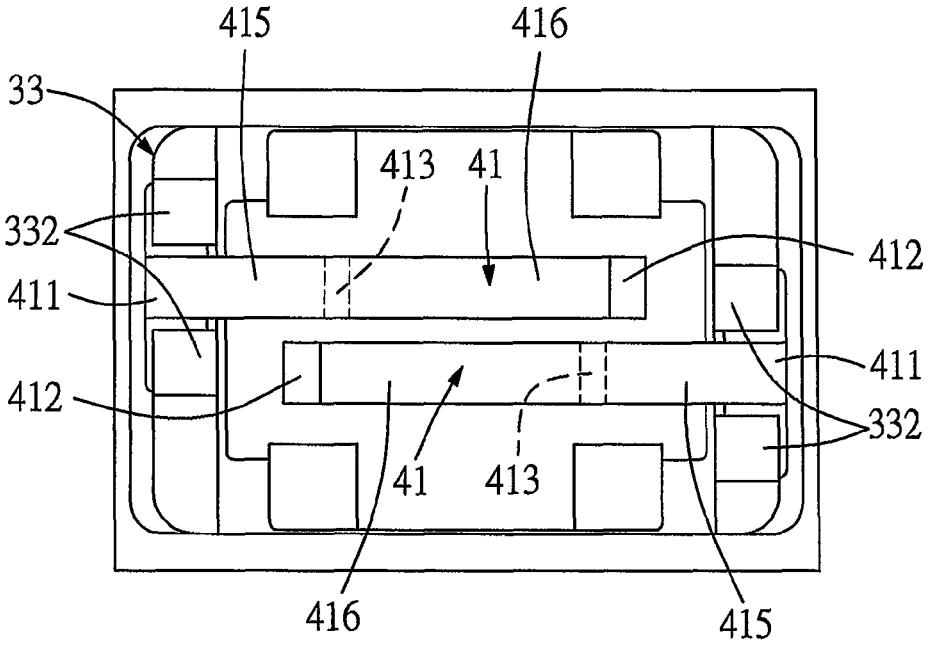
FIG. 13 is a top view of the third preferred embodiment of the punching device according to this invention.

FIG. 13 illustrates the third preferred embodiment of the punching device 300 according to this invention. The third preferred embodiment differs from the previous embodiments in that the first and second end segments 415, 416 of each of the driving levers 41 extend in the same length direction and that the pivot seats 332 are offset from each other in the length direction of the first and second end segments 415, 416.

With the invention thus explained, it is apparent that various modifications and variations can be made without departing from the spirit of the present invention.

What is claimed is:

1. A punching device for cutting a sheet, comprising:

a housing defining an inner housing space and having a surrounding frame part, an upper part and a flange part, said surrounding frame part having upper and lower end portions, said upper part being movably supported on said upper end portion of said surrounding frame part and having an abutting protrusion, said flange part being formed with a lower spring-holding member, and defining a flange hole;

two opposite pivot seats protruding upwardly from said flange part into said inner housing space and opposite to each other in a first direction;

a die part disposed below and operatively connected to said flange part;

a punch unit including a punch head, an upper spring-holding member, and a punch, said upper spring-holding member protruding upwardly from said punch head, said punch being disposed between said pivot seats and extending downwardly from said punch head toward said die part;

a spring extending between and abutting against said upper and lower spring-holding members, so that said punch unit can be supported movably on said flange part and that said punch is slidable through said flange hole and against said die part along a vertical axis substantially perpendicular to the first direction; and a pressing unit including two driving levers, each of which has a pivot end that is pivoted to a respective one of said pivot seats, a pressing end that is opposite to said pivot end, a first end segment that extends along a first line of its length direction from said pivot end, a second end segment that extends along a second line of its length direction from said pressing end, a middle segment that interconnects and that deflects from said first and second end segments, and a driving protrusion disposed between said pivot end and pressing end of each of said driving levers and protruding therefrom toward said punch unit, said middle segment having curved first and second end portions that turn curvedly and respectively from said first and second end segments, said first lines, along which said first end segments extend, intersecting each other at said vertical axis, said second lines, along which said second end segments extend, being substantially parallel to each other and being spaced apart from said vertical axis, said vertical axis being disposed between said driving protrusions of said driving levers, said driving protrusions of said driving levers being disposed in a symmetrical manner with respect to said vertical axis and pressing against said punch unit to drive movement of said punch unit along said vertical axis toward said die part for cutting the sheet, said upper part being disposed on and abutting against said pressing ends of said driving levers and being movable relative to said surrounding frame part along said vertical axis for pressing said driving levers to rotate relative to said surrounding frame part;

wherein said driving levers are rotatable relative to said surrounding frame part about first and second rotational axes, respectively, between an initial position and a cutting position, said first and second rotational axes being transverse to the first direction and said vertical axis;

wherein when said driving levers are disposed at the initial position, said abutting protrusion of said upper part is pushed by said pressing ends of said driving levers to abut against said upper end portion of said surrounding frame part by the urging action of said spring and in the meantime said driving levers extend upwardly and respectively from said pivot ends to said pressing ends and cross each other; and wherein when said driving levers are disposed at the cutting position, said abutting protrusion of said upper part is spaced apart from said upper end portion of said surrounding frame part.

2. The punching device of claim 1, wherein said second end portions of said middle segments of said driving levers overlap each other in a second direction, which is perpendicular to said vertical axis and said first direction when said driving levers are disposed at the initial position, said second end segment of one of said driving levers overlapping said first end segment of the other one of said driving levers in the second direction and said second end segment of said the other one of said driving levers overlapping said first end segment of said one of said driving levers in the second direction when said driving levers are disposed at the cutting position.

3. The punching device of claim 1, further comprising a plurality of magnets attached to said flange part and said die part, said flange part being magnetically connected to said die part by said magnets.

* * * * *